US006397943B1

(12) United States Patent
Egara

(10) Patent No.: US 6,397,943 B1
(45) Date of Patent: Jun. 4, 2002

(54) THERMOSTATIC COOLANT CIRCULATING DEVICE

(75) Inventor: Yoshitaka Egara, Tsukuba-gun (JP)

(73) Assignee: SMC Corporation, Tokyo (JP)

( * ) Notice: Subject to any disclaimer, the term of this patent is extended or adjusted under 35 U.S.C. 154(b) by 0 days.

(21) Appl. No.: 09/599,883

(22) Filed: Jun. 23, 2000

(30) Foreign Application Priority Data

Aug. 25, 1999 (JP) ..... 11-238632

(51) Int. Cl.[7] ..... F25B 29/00

(52) U.S. Cl. ..... 165/263; 165/205; 62/185; 62/201

(58) Field of Search ..... 165/205, 206, 165/263, 255, 264, 299, 300; 62/98, 99, 117, 185, 201, 196.4; 222/146.1

(56) References Cited

U.S. PATENT DOCUMENTS 2,876,327 A * 3/1959 Leisey ..... 165/255
4,850,201 A * 7/1989 Oswalt et al. ..... 62/185
5,862,675 A 1/1999 Scaringe et al. ..... 62/193.3
6,003,595 A * 12/1999 Watanabe ..... 165/263 X

* cited by examiner

*Primary Examiner*—Ljiljana Ciric
(74) *Attorney, Agent, or Firm*—Oblon, Spivak, McClelland, Maier & Neustadt, P.C.

(57) ABSTRACT

A thermostatic coolant circulating device includes a supply circuit for circulating a coolant to a load and a cooling circuit for cooling the coolant from a temperature to which the coolant was raised by cooling the load. The supply circuit includes a tank for storing the coolant, a pump for circulating the coolant in the tank to the load through an external pipe, a coolant adjustment chamber, and a gas supplying and discharging unit. The coolant adjustment chamber is a closed structure except for a communication aperture at a lower end of the chamber. The communication aperture is in fluid communication with the inside of the tank. The gas supplying and discharging unit is connected to the adjustment chamber for supplying a gas into the adjustment chamber so as to allow the coolant in the adjustment chamber to flow out through the communication aperture into the tank.

6 Claims, 2 Drawing Sheets

THERMOSTATIC COOLANT CIRCULATING DEVICE

FIELD OF THE INVENTION

The present invention relates to a thermostatic coolant circulating device for circulating a thermostatic coolant to a load.

PRIOR ART

FIG. 3 shows an example of a previously proposed thermostatic coolant circulating device. This circulating device 1 includes a supply circuit 3 for circulating a thermostatic coolant to a load 2 and a cooling circuit 4 for cooling the aforesaid coolant, the coolant having a temperature previously raised by cooling the load 2.

In the aforesaid supplying circuit 3, the coolant having a temperature raised by cooling the load 2 refluxes through a return pipe 6 to a heat exchanger 7. After the coolant is cooled below a set temperature in this heat exchanger 7 by heat exchange with a refrigerant flowing through an evaporator 18 of the aforesaid cooling circuit 4, the coolant flows into a heating vessel 8 and is heated by a heater 9 approximately to a set temperature. Thereafter, the coolant overflows the heating vessel 8 to flow into a tank 10. Then, the coolant is supplied to the aforesaid load 2 again through an external pipe 12 by a pump 11. In FIG. 3, a temperature sensor 13 that measures the temperature of the coolant and a temperature controller 14 that controls the aforesaid heater 9 on the basis of a measurement signal from the temperature sensor 13 are shown.

On the other hand, the aforesaid cooling circuit 4 is constructed as a sequential series connection of a compressor 15 that compresses a refrigerant into a high-temperature high-pressure refrigerant gas, a water-cooled condenser 16 that cools and condenses the refrigerant gas into a high-pressure liquid refrigerant, a pressure reducing valve 17 that reduces the pressure of the liquid refrigerant to lower the temperature thereof, the aforesaid evaporator 18 that evaporates the liquid refrigerant having the pressure reduced by the pressure reducing valve 17 by heat exchange with the coolant, and an accumulator 19.

Generally, in such a circulating device, when the operation of the aforesaid pump 11 begins and the coolant or in the tank 10 starts to be supplied to the load 2 through the external pipe 12, the amount of liquid in the tank 10 decreases by the amount that has flowed into the external pipe 12 and the load 2, thereby to lower the liquid level. For this reason, it is necessary to fill the aforesaid tank 10 with a sufficient amount of the coolant in advance so as not to cause an obstacle to the operation of the pump 11 even if the liquid level lowers. This necessarily leads to an increased amount of use of the coolant.

However, since an extremely expensive completely fluorinated liquid is used as the aforesaid coolant, the initial cost is high if the amount used is large. Therefore, it is desired to make it possible to cool the load with as small an amount of coolant as possible.

However, if the amount of the coolant to be stored in the tank is simply reduced, there is a fear that the liquid level in the tank lowers to the position of the suction inlet of the pump when the operation of the device begins and the coolant starts to be supplied to the load. This causes an obstacle to the operation of the aforesaid pump.

SUMMARY OF THE INVENTION

An object of the present invention is to provide a thermostatic coolant circulating device having a rationally designed structure with a low initial cost and being capable of cooling a load with the use of a small amount of coolant while adjusting the liquid level in a tank so as not to cause an obstacle to the operation of a pump.

In order to achieve the aforesaid object, the present invention provides a thermostatic coolant circulating device comprising a supplying circuit for circularly supplying a coolant to a load and a cooling circuit for cooling the coolant having a temperature raised by cooling the load.

The aforesaid supplying circuit comprises a tank for storing the coolant; a pump for circulating the coolant in said tank to the load through an external pipe; a coolant adjustment chamber of a closed structure having a communication aperture at a lower end thereof, the communication aperture being in communication with an inner bottom of the tank; and a gas supplying and discharging means connected to the adjustment chamber and having a function of allowing the coolant in the adjustment chamber to flow out through the communication aperture into the tank by supplying a gas into the adjustment chamber and a function of allowing a part of the coolant in the tank to flow into the adjustment chamber through the communication aperture by discharging the gas in said adjustment chamber.

In a circulating device having the aforesaid construction, when the operation thereof is stopped and the whole amount of the coolant is recollected in the tank, the gas in the adjustment chamber is discharged and a part of the coolant flows into the adjustment chamber.

When the operation of the device is started in this state, the coolant in the tank is circularly supplied to the load through the external pipe by the pump. This reduces the amount of the in the tank by the amount supplied to the load, thereby to lower the liquid level. However, in this state, the gas is supplied from the gas supplying and discharging means into the adjustment chamber and the coolant in the aforesaid adjustment chamber is discharged into the tank through the aperture, thereby compensating for the decrease in the amount of the coolant in the tank with the use of the coolant discharged from the adjustment chamber to prevent the liquid level from lowering.

In the case of stopping the operation of the aforesaid circulating device and recollecting the coolant that has flowed into the external pipe and the load to store it in the tank, the gas in the aforesaid adjustment chamber is discharged by the gas supplying and discharging means and a part of the coolant in the tank is allowed to flow into the adjustment chamber, thereby to absorb the recollected coolant from the external pipe and the load by means of the adjustment chamber.

Thus, by allowing the change of the liquid amount in the tank to be absorbed with the use of the aforesaid adjustment chamber, the load can be cooled even with a small amount of the coolant while maintaining the liquid level in the aforesaid tank so as not to cause an obstacle to the operation of the pump. Further, at the time of shutdown of the device, the can be stored with certainty by auxiliarily using the aforesaid adjustment chamber even if the volume of the tank itself is so small that the tank cannot store the whole amount of the coolant.

In the present invention, the aforesaid adjustment chamber preferably has a volume large enough to store the coolant in the aforesaid external pipe including the load.

In the present invention, the aforesaid adjustment chamber may be disposed either in the inside or on the outside of the tank.

According to one specific embodiment of the present invention, the aforesaid gas supplying and discharging means includes a compressed gas source for supplying a dried compressed gas and a switching valve connected in a pipe passageway that connects the aforesaid compressed gas source and the aforesaid adjustment chamber.

According to another specific embodiment of the present invention, the aforesaid supplying circuit includes a heat exchanger that cools the coolant having a temperature raised by cooling the load and refluxing into the tank by heat exchange with a refrigerant in the aforesaid cooling circuit, and a heater for heating the coolant cooled below a set temperature by the aforesaid heat exchanger to approximate the coolant to the set temperature.

DETAILED DESCRIPTION OF THE PREFERRED EMBODIMENTS

Figure 1:
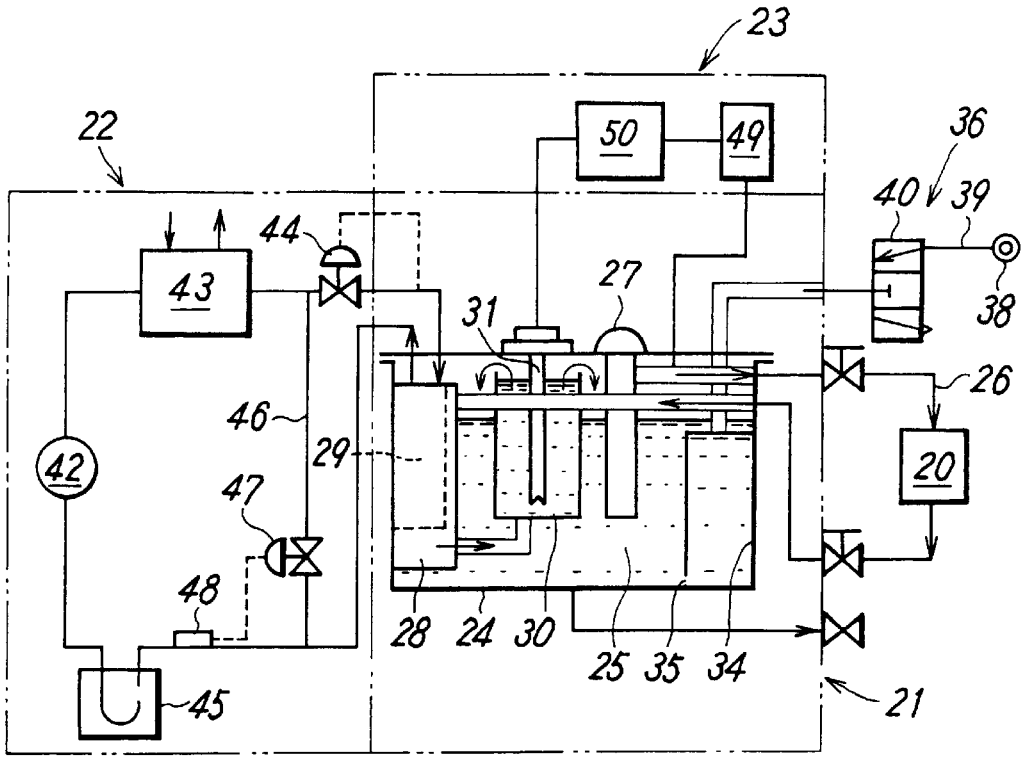
FIG. 1 is a construction view showing the first Example of the thermostatic coolant circulating device of the present invention.

The thermostatic coolant circulating device of the first Example shown in FIG. 1 includes a coolant supplying circuit 21 for circularly supplying a coolant to a load 20, a cooling circuit 22 for cooling the aforesaid coolant having a temperature raised by cooling the load 20, and a control section 23 for controlling a heater 31 in the aforesaid supplying circuit 21.

The aforesaid supplying circuit 21 includes a tank 24 for storing the coolant 25. In the inside of the tank 24, there are disposed a pump 27 for circularly supplying the coolant 25 in the aforesaid tank 24 to the load 20 through an external pipe 26, a heat exchanger 28 that cools the aforesaid coolant having a temperature raised by cooling the load 20 and refluxing by heat exchange with a refrigerant in an evaporator 29, a heating vessel 30 that receives the coolant 25 from the aforesaid heat exchanger 28 and then allows the coolant 25 to flow into the aforesaid tank 24 in an overflowing manner, and the aforesaid heater 31 that is stored in the heating vessel 30 and heats the coolant 25 cooled below a set temperature by the aforesaid heat exchanger 28 to approximate it to the set temperature.

Further, in the inside of the aforesaid tank 24, a coolant adjustment chamber 34 is formed to occupy a part of the coolant storing space. This adjustment chamber 34 has a closed structure except that a communication aperture 35 that is in communication with an inside bottom of the aforesaid tank 24 is open at a lower end thereof, and an upper end thereof is connected to a gas supplying and discharging means 36.

The aforesaid gas supplying and discharging means 36 includes a compressed gas source 38 for supplying a dried compressed gas such as nitrogen gas or air and a switching valve 40 connected in a pipe passageway 39 that connects the aforesaid compressed gas source 38 and the aforesaid adjustment chamber 34. The switching valve 40 illustrated in the Figure switches to three positions including the first position that connects the aforesaid adjustment chamber 34 to the compressed gas source 38, the second position that releases the aforesaid adjustment chamber to the outside, and the third position that cuts off the aforesaid adjustment chamber from both the compressed gas source 38 and the outside; however, it is not limited to such one alone. In short, it is sufficient if the switching valve 40 has a construction capable of supplying the gas into the aforesaid adjustment chamber 34 or discharging the gas in the aforesaid chamber. Further, when the aforesaid adjustment chamber 34 is connected to the compressed gas source 38 by the switching valve 40, the gas is supplied to the inside of the aforesaid adjustment chamber 34 to allow the coolant in the aforesaid chamber to flow out into the tank 24 through the aforesaid communication aperture 35. Further, when the aforesaid adjustment chamber 34 is released to the outside, the gas in the aforesaid adjustment chamber 34 is discharged, and a part of the coolant 25 in the tank 24 flows into the aforesaid adjustment chamber 34 through the aforesaid communication aperture 35.

The aforesaid adjustment chamber 34 has a volume capable of storing the coolant of substantially the same amount or a little more amount than the coolant that fills the external pipe 26 and the load 20. Further, the aforesaid tank 24 is formed to have a volume capable of storing the whole amount of the coolant excluding the coolant contained in the aforesaid external pipe 26 and the load 20.

Here, in the Figure, the aforesaid adjustment chamber 34 is formed as a section at a position near one end of the tank 24. However, the aforesaid adjustment chamber can be disposed at an arbitrary position on condition that it does not interfere the aforesaid pump 27 and other members placed in the aforesaid tank 24. Further, the aforesaid communication aperture 35 may be one or more holes disposed at a lower end of the side wall surrounding the adjustment chamber 34 or may be a slit formed by separating a lower end of the aforesaid side wall from the bottom surface of the tank.

On the other hand, the aforesaid cooling circuit 22 is constructed as a sequential series connection of a compressor 42 that compresses a refrigerant into a high-temperature high-pressure refrigerant gas, a water-cooled condenser 43 that cools and condenses the refrigerant gas from the compressor 42 into a high-pressure liquid refrigerant, a pressure reducing valve 44 that reduces the pressure of the liquid refrigerant to lower the temperature thereof, the aforesaid evaporator 29 that evaporates the liquid refrigerant having the pressure reduced by the pressure reducing valve 44, and an accumulator 45. In the Figure, there are shown an overheat preventing circuit 46 for mixing a part of the refrigerant from the condenser 43 to lower the temperature when the temperature of the refrigerant flowing from the evaporator 29 into the accumulator 45 is high, an overheat preventing valve 47 that opens and closes the overheat preventing circuit 46, and a temperature sensor 48 that senses the temperature of the refrigerant on the upstream side of the accumulator 45 to output a signal of opening or closing the overheat preventing valve 47.

Further, the aforesaid control section 23 includes a temperature sensor 49 having a measuring section near an ejection outlet of the pump 27 and a temperature controller 50 that controls the aforesaid heater 31 on the basis of a measurement signal from the temperature sensor 49. The control section 23 measures the temperature of the coolant 25 supplied from the aforesaid tank 24 to the load 20 by means of the aforesaid temperature sensor 49, compares the measured temperature with the set temperature in the temperature controller 50, and controls the amount of energization of the aforesaid heater 31 so that the difference between the measured temperature and the set temperature will be near to zero.

In a circulating device having the aforesaid construction, when the operation thereof is stopped and the whole amount of the coolant 25 is recollected in the tank 24, the gas in the adjustment chamber 34 is discharged by the gas supplying and discharging means 36, and a part of the coolant flows into the adjustment chamber 34.

When the operation of the device is started in this state, the coolant 25 in the tank 24 is circularly supplied to the load 20 through the external pipe 26 by the pump 27. This reduces the amount of the liquid in the tank 24 by the amount that has flowed out to the external pipe 26, the load 20, and others, thereby to lower the liquid level. However, in this state, the switching valve 40 of the gas supplying and discharging means 36 is switched to connect the adjustment chamber 34 to the gas source 38, whereby the compressed gas is supplied into the adjustment chamber 34, and the coolant 25 in the aforesaid adjustment chamber 34 is discharged into the tank 24 through the communication aperture 35. This compensates for the decrease in the amount of the coolant 25 in the tank 24 with the use of the coolant 25 discharged from the adjustment chamber 34 to prevent the liquid level from lowering. As a result, the liquid level of the coolant 25 in the aforesaid tank 24 is maintained to be constant without causing an obstacle to the operation of the pump 27.

On the other hand, the coolant having a temperature raised by cooling the load 20 is cooled below the set temperature by heat exchange with the refrigerant in the evaporator 29 in the aforesaid heat exchanger 28, and then heated by the heater 31 approximately to the set temperature. Thereafter, the coolant flows from the heating vessel 30 into the tank 24, and is supplied to the load 20 again by the pump 27.

In the case of stopping the operation of the aforesaid circulating device and recollecting the coolant that fills the external pipe 26, the load 20, and others to allow the tank 24 to store the whole amount of the cooling liquid, the switching valve 40 is switched to release the aforesaid adjustment chamber 34 to the outside, and the gas in the aforesaid adjustment chamber 34 is discharged to allow a part of the coolant in the tank 24 to flow into the adjustment chamber 34, thereby to allow the adjustment chamber 34 to store the same amount of the coolant as the recollected coolant from the aforesaid external pipe 26, the load 20, and others. This allows the whole amount of the coolant to be stored in the tank 24 and the adjustment chamber 34 without raising the liquid level in the tank 24. Further, since the coolant in the load 20 and the external pipe 26 can be thus recollected, as it is, into the tank 24, there is no need to recollect the coolant from the external pipe to a different vessel. As a result, in the case of using fluorinated liquid that is not decomposed to water as the aforesaid coolant, contamination of the environment caused by leakage of this fluorinated liquid to the outside is eliminated.

Figure 2:
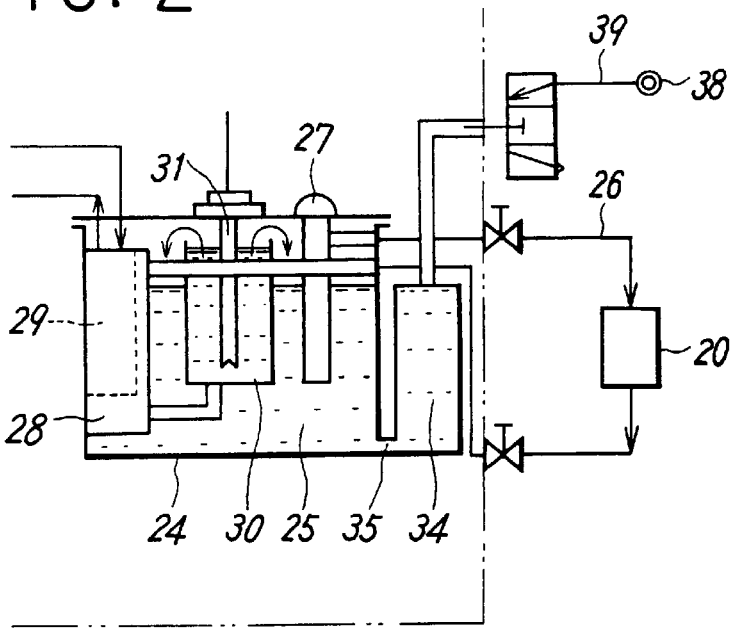
FIG. 2 is a construction view of an essential part showing the second Example of the thermostatic coolant circulating device of the present invention.
Figure 3:
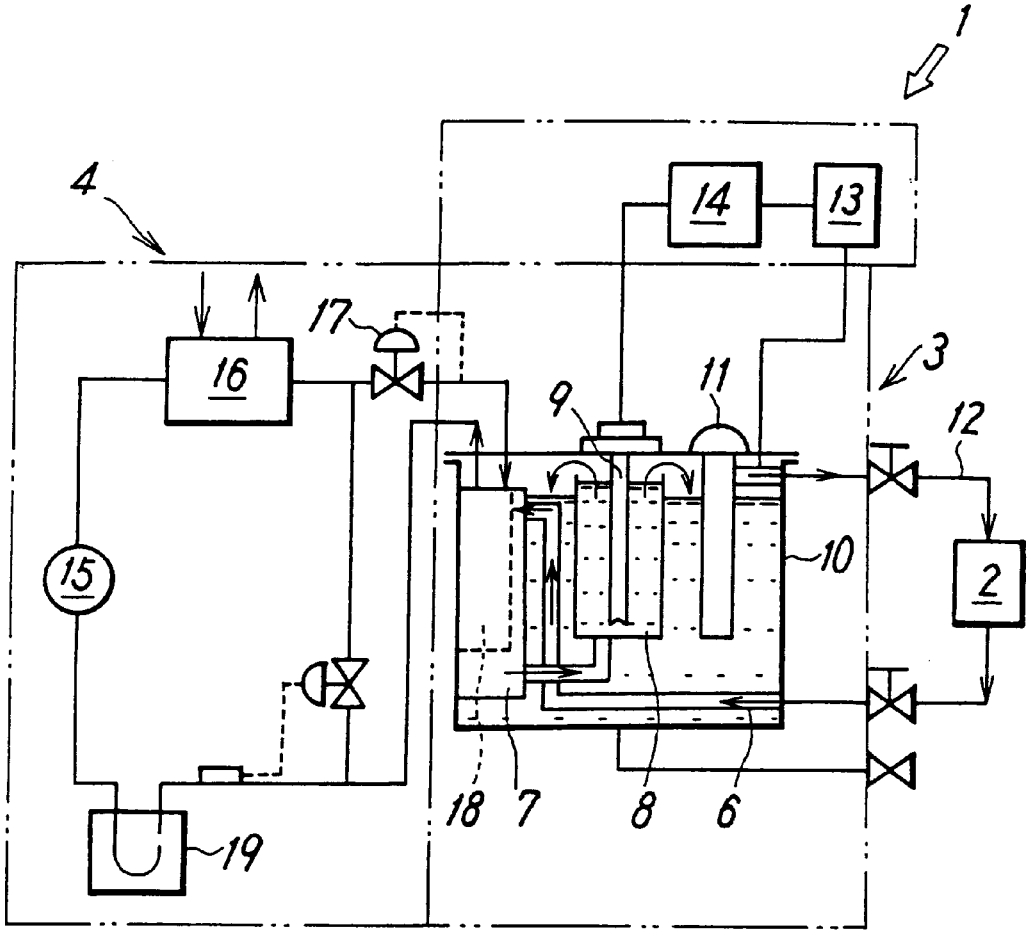
FIG. 3 Background Art
FIG. 3 is a construction view showing an already proposed thermostatic coolant circulating device.

FIG. 2 shows an essential part of the second Example of the circulating device according to the present invention. The difference between the second Example and the aforesaid first Example lies in that the coolant adjustment chamber 34 is disposed on the outside of the tank 24 in the second Example, whereas it is disposed in the inside of the tank 24 in the first Example. In other words, the aforesaid adjustment chamber 34 is disposed on the outside of the tank 24 at a position adjacent to the aforesaid tank, and the lower end of the adjustment chamber 34 and the inner bottom of the tank 24 are brought into communication with each other by means of the communication aperture 35.

The constituent elements of the second Example other than those described above are substantially the same as those of the first Example, so that explanation thereof will be omitted by denoting same principal constituent parts with same numerals in the first Example.

Thus, according to the present invention, even if the amount of use of the coolant is reduced to a great extent as compared with a conventional one, the device can be operated safely and with certainty by adjusting the liquid level of coolant in a tank with the use of an adjustment chamber disposed in the aforesaid tank to maintain the liquid level constantly at a height that does not cause an obstacle to the operation of a pump. Further, even if the volume of the aforesaid tank itself is so small that it cannot store the whole amount of the coolant, the whole amount including the coolant recollected from a load can be stored in the tank with certainty by allowing a part of the coolant to flow into the aforesaid adjustment chamber at the time of shutdown of the device.

What is claimed is:

1. A thermostatic coolant circulating device comprising a supply circuit for circulating a coolant to a load and a cooling circuit for cooling the coolant from a temperature to which the coolant has been raised by cooling the load, said supply circuit comprising:

a tank for storing said coolant;

a pump for circulating the coolant in said tank to the load through an external pipe;

a coolant adjustment chamber of a closed structure except for a communication aperture at a lower end of said chamber, said communication aperture being in fluid communication with the inside of said tank; and a gas supplying and discharging means, connected to said adjustment chamber, for supplying a gas into said adjustment chamber so as to allow the coolant liquid in said adjustment chamber to flow out through said communication aperture into the tank.

2. A thermostatic coolant circulating device as set forth in claim 1, said adjustment chamber having a volume large enough to accommodate the coolant which in said external pipe and the load.

3. A thermostatic coolant circulating device as set forth in claim 1, said adjustment chamber being disposed on the inside of said tank.

4. A thermostatic coolant circulating device as set forth in claim 1, said adjustment chamber being disposed on the outside of said tank.

5. A thermostatic coolant circulating device as set forth in claim 1, said gas supplying and discharging means including a compressed gas source for supplying a dried compressed gas and a switching valve connected to a pipe passageway that connects said compressed gas source and said adjustment chamber.

6. A thermostatic coolant circulating device as set forth in claim 1, said supply circuit including a heat exchanger that cools the coolant from a temperature to which the coolant has been raised by cooling the load and refluxing into the tank by heat exchange with a refrigerant in said cooling circuit, and also including a heater for heating the coolant previously cooled from below a set temperature to approximately the set temperature.

* * * * *